United States Patent [19]

Holt et al.

[11] 4,369,743

[45] Jan. 25, 1983

[54] ELECTRONIC LUBRICANT METERING SYSTEM

[75] Inventors: James L. Holt; John M. Mahoney, both of Bristol, Wis.; Kenneth M. McLeod, Lake Villa, Ill.

[73] Assignee: Outboard Marine Corporation, Waukegan, Ill.

[21] Appl. No.: 304,666

[22] Filed: Sep. 22, 1981

[51] Int. Cl.[3] ..... F02B 33/04; F01M 1/00

[52] U.S. Cl. ..... 123/196 S; 123/73 AD

[58] Field of Search ..... 123/73 AD, 196 S

[56] References Cited

U.S. PATENT DOCUMENTS

| | | | |
|---|---|---|---|
| 3,114,356 | 12/1963 | Werner et al. | 123/73 AD |
| 3,140,700 | 7/1964 | Nallinger | 123/73 AD |
| 3,297,008 | 1/1967 | Alt et al. | 123/73 AD |
| 3,561,565 | 2/1971 | Woor | 123/196 S |
| 3,886,914 | 6/1975 | Ahrns et al. | 123/73 AD |
| 4,121,559 | 10/1978 | Yamada | 123/196 S |

*Primary Examiner*—Charles J. Myhre
*Assistant Examiner*—E. Rollins Cross
*Attorney, Agent, or Firm*—Michael, Best & Friedrich

[57] ABSTRACT

Disclosed herein is an electronic lubricant metering system for an engine which includes a throttle for regulating the amount of fuel delivered to the engine, the system comprising a frequency to voltage converter for producing a first electrical signal representative of engine RPM, a potentiometer including a wiper coupled to move in response to movement of the engine throttle, the voltage appearing on the wiper producing a second electrical signal representative of the amount of fuel being delivered to the engine, an oil pump for supplying a variable amount of lubricant into the fuel delivered to the engine, and an electrical control circuit responsive to the first and second electrical signals for providing a control output which renders the oil pump operative to vary the lubricant/fuel ratio of the lubricant and fuel mixture delivered to the engine.

12 Claims, 1 Drawing Figure

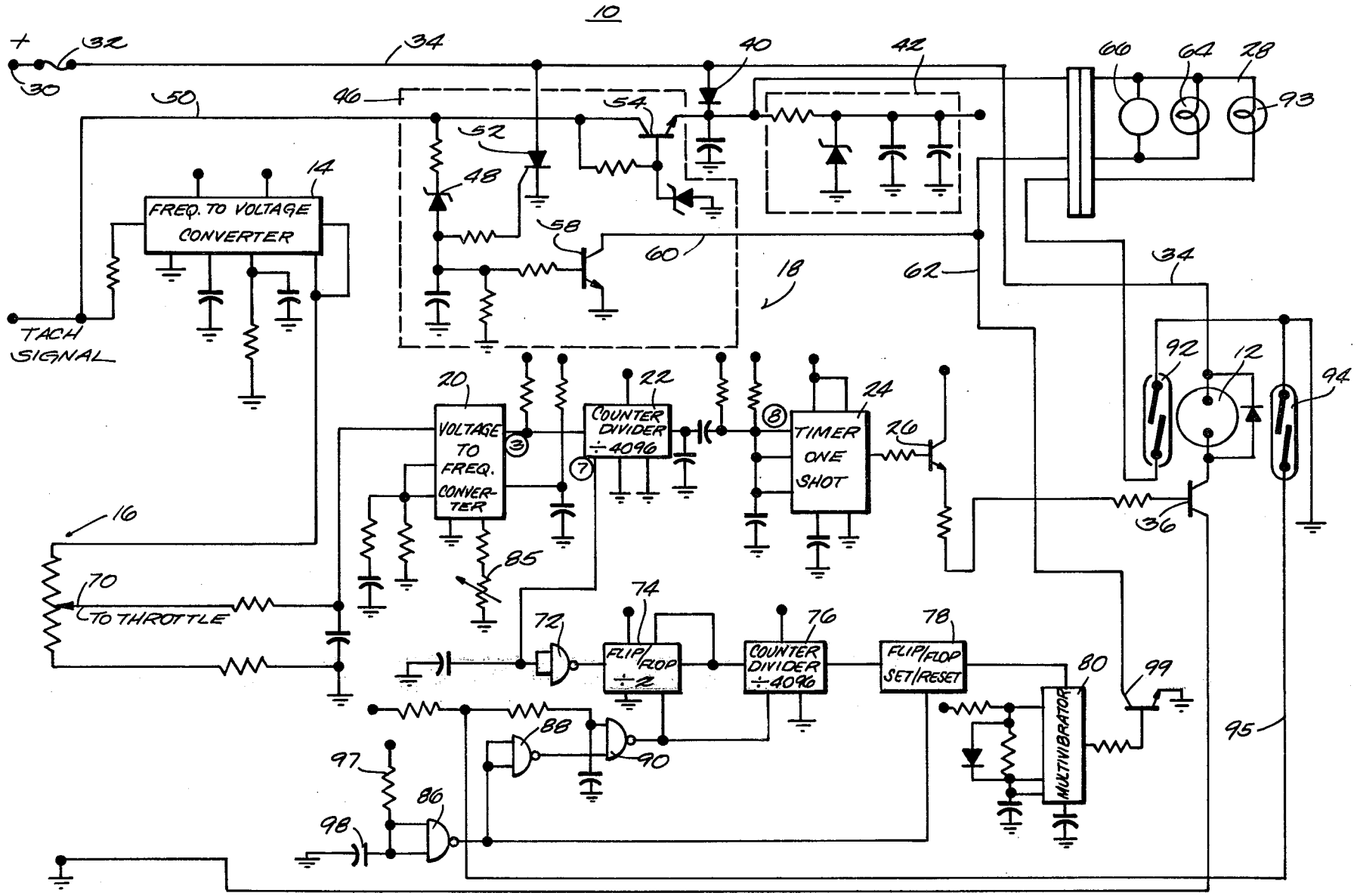
FREQ. TO VOLTAGE CONVERTER
TACH SIGNAL
TO THROTTLE
VOLTAGE TO FREQ. CONVERTER
COUNTER DIVIDER ÷4096
TIMER ONE SHOT
COUNTER DIVIDER ÷4096
FLIP FLOP ÷2
FLIP FLOP SET/RESET
MULTIVIBRATOR

ELECTRONIC LUBRICANT METERING SYSTEM

BACKGROUND OF THE INVENTION

The invention relates generally to a lubricant metering system utilized with certain fuel burning engines, such as two-cycle outboard marine engines, where it is necessary to mix lubricant and fuel in order to lubricate the engine seals and bearings. More particularly, the invention relates to lubricant metering systems which vary the ratio of the lubricant to fuel in the lubricant and fuel mixture supplied to the engine.

Attention is directed to the following U.S. Patents which disclose various lubricant metering systems:

| | | |
|---|---|---|
| Werner | 3,114,356 | Issued December 17, 1963 |
| Nallinger | 3,140,700 | Issued July 14, 1964 |
| Woor | 3,561,565 | Issued February 9, 1971 |
| Ahrns | 3,886,914 | Issued June 3, 1975 |
| Yamada | 4,121,559 | Issued October 24, 1978 |

SUMMARY OF THE INVENTION

The invention disclosed herein provides an electronic lubricant metering system for an engine, the system including first means for producing a first electrical signal representative of engine RPM, second means for producing a second electrical signal representative of the amount of fuel being delivered to the engine, lubricant supply means for supplying a variable amount of lubricant into the fuel delivered to the engine, and electrical control means responsive to the first and second electrical signals for providing a control output which renders the lubricant supply means operative to vary the lubricant/fuel ratio of the lubricant and fuel mixture delivered to the engine.

In accordance with an embodiment of the invention, the engine includes a throttle for regulating the amount of fuel delivered to the engine, and the second means is coupled to the throttle so that the second electrical signal is representative of engine throttle position. In a preferred embodiment, the second means comprises a potentiometer including a wiper coupled to move in response to movement of the engine throttle, the voltage appearing on the wiper providing the second electrical signal.

Also in accordance with an embodiment of the invention, the first means comprises means to provide an analog DC voltage representative of engine RPM, and the second means comprises a potentiometer connected so that the analog DC voltage is impressed across the potentiometer, the potentiometer including a wiper coupled to move in response to movement of the engine throttle so that the voltage output from the potentiometer wiper is a function of engine RPM and engine throttle position.

Also in accordance with an embodiment of the invention, the engine includes a power source for providing power to the lubricant supply means and also includes transducer means for generating a voltage processed by the first means for producing the first electrical signal respresentative of engine RPM, the system further comprising overvoltage detection means including an operator warning device, the overvoltage detection means being coupled to the transducer means and to the power supply for interrupting the power supplied to the lubricant supply means and for activating the operator warning device when the voltage generated by the transducer means exceeds a predetermined upper value.

The invention disclosed herein also provides a lubricant metering circuit for an engine including a throttle for regulating the amount of fuel delivered to the engine, which engine is connected to a lubricant pump for supplying a variable amount of lubricant into the fuel delivered to the engine. The lubricant metering circuit includes first means for producing a first electrical signal representative of engine RPM, second means for producing a second electrical signal representative of engine throttle position, and electrical control means responsive to the first and second electrical signals for providing a control output which renders the lubricant supply means operative to vary the lubricant/fuel ratio of the lubricant and fuel mixture delivered to the engine.

One of the principal features of the invention is the provision of a lubricant metering system for an engine, which system includes electrical control means responsive to electrical signals representative of engine RPM and movement of the engine throttle for providing a control output which renders a lubricant supply means or oil pump operative to vary the lubricant/fuel ratio of a lubricant and fuel mixture delivered to the engine.

Other features and advantages of the embodiments of the invention will become known by reference to the following drawing, general description, and claims.

DRAWING

The single FIGURE is a schematic and diagramatic block diagram of an electronic lubricant metering system embodying various of the features of the invention.

Before explaining the embodiments of the invention in detail, it is to be understood that the invention is not limited in its application to the details of construction and arrangements of components set forth in the following description or illustrated in the drawings. The invention is capable of other embodiments and of being practiced and carried out in various ways. Also, it is to be understood that the phaseology and terminology employed herein is for the purpose of description and should not be regarded as limiting.

GENERAL DESCRIPTION

Shown in the single FIGURE is an electronic lubricant metering system 10 for an engine (not completely shown) which operates to control a lubricant supply means or oil pump 12 to vary the lubricant/fuel ratio of the lubricant and fuel mixture delivered to the engine. Generally, the electronic lubricant metering system includes circuitry to generate pulses which have a frequency which varies as a function of engine RPM and throttle position, which pulses control operation of the oil pump 12 to vary the lubricant/fuel ratio. The higher the engine RPM and the more open the throttle, the greater the fuel to lubricant ratio, for example, up to a maximum ratio of 50:1. At low engine RPM and more closed throttle setting, the minimum fuel to lubricant ratio is provided, for example, 150:1.

In the illustrated embodiment, the system includes means, preferably a frequency to voltage converter 14, which receives a tachometer signal from a suitable engine transducer and operates to produce a first electrical signal or analog DC voltage representative of engine RPM. The system also includes second means, preferably a potentiometer 16, for producing a second electrical signal representative of the displacement of the engine throttle or the amount of fuel being delivered to the engine. Electronic control means, generally designated 18, is responsive to the first and second electrical signals for providing an output which renders the oil pump 12 operative to vary the lubricant/fuel ratio of the lubricant and fuel mixture delivered to the engine. The control means preferably includes a voltage to frequency converter, 20, a 12 stage binary counter 22, an IC timer 24, and a transistor 26, connected to the output of the timer 24. Transistor 26 controls a Darlington transistor 36 which turns on or energizes the oil pump 12 when rendered conductive.

The system 10 also includes an instrument head or gauge 28, which informs the operator of the status of the metering system and fault detector circuitry as will be explained in more detail below.

Before continuing with a more detailed description of the electronic lubricant metering system 10, it should be noted that throughout this description, reference will be made to discrete or single integrated circuit (IC) components and to components such as NAND gates, zener diodes, and other electrical devices. It is to be understood that these separate, individual devices are conventional and can be made up of suitable commercially available integrated circuits or other circuit elements which perform the required functions. Also, it will be apparent to those skilled in the art that many or all of the discrete IC's and other devices could be combined into one or more larger IC's or a microprocessor, which performs the same functions. Specific suitable components corresponding to the "block diagrammed" components shown in the drawing will be identified in a list set forth below.

Returning to a more detailed description of the illustrated metering system 10, power is provided from a positive terminal 30 connected to a source of DC voltage, such as a 12 volt battery (not shown), through a fuse 32 and to the oil pump 12 by a lead 34. The current flow through a solenoid coil (not shown) incorporated in the pump is controlled by the Darlington transistor 36, which in turn is switched on and off by the control output of transistor 26, included in the electronic control means 18. The oil pump stroke takes, for example, approximately one quarter second to deliver 0.3 cc's of oil per stroke of the pump. The transistor 26 of the electronic control means 18 delivers quarter second control output pulses to the pump 12, and it is the changing of the frequency of these control output pulses which varies the oil/fuel ratio of the oil and gas mixture delivered to the engine.

The system circuitry is provided with a regulated voltage, for example, 8.2 volts via a diode 40 connected to line 34 and a voltage regulator, generally designated 42, (shown within a dashed-line box) made up of conventional components including a zener diode and capacitors (not individually labelled) as shown.

An overvoltage detection circuit, generally designated 46, (shown within a dashed-line box) is also provided to short out the battery and interrupt power to the pump by blowing the fuse 32, but at the same time maintain power to the instrument head, if the tachometer signal voltage provided to the input of the frequency to voltage converter 14 becomes excessive, for example, in excess of 20 volts. More particularly, if the tachometer signal exceeds 20 volts, a zener diode 48, connected to the tachometer signal by line 50, breaks down, thereby gating or turning on an SCR 52 which shorts the battery terminal 30 to ground and blows fuse 32, because the anode of the SCR 52 is connected to line 34. At the same time, a pass through transistor 54 connected to line 50 as shown, turns on so power is supplied from the tach signal to the instrument head and via voltage regulator 42 to the system circuitry.

The overvoltage detection circuit also includes a transistor 58 which turns on when zener diode 48 conducts and is connected by lines 60 and 62 to the instrument head 28 so that a red warning light 64 and warning horn 66 are energized to alert the engine operator to the overvoltage condition. Resistors, a capacitor and a zener diode (not specifically labelled) are also connected in the fault detector circuit as shown. The other components included in the metering system 10 will be identified in the further description of operation which follows.

A tachometer signal, such as is produced from an alternator (not shown), is fed to the input of the frequency to voltage converter 14, which provides an analog DC voltage applied to the potentiometer 16. The wiper 70, of the potentiometer 16 is suitably mechanically connected to the engine throttle (not shown). Thus, the voltage on the potentiometer wiper 70 is a function of engine RPM and throttle position. This wiper voltage is applied to the voltage to frequency converter 22 which is conventionally connected to a 1 K potentiometer 85 to allow calibration, i.e. to allow adjustment of the frequency of the output which is applied to the clock input of the 12 stage binary counter which divides the frequency by 4096. The output of the frequency divider 22 is capacitively coupled to Pin 8 of the timer 24, which is configured to provide a quarter second pulse to drive the output transistor 26, which in turn drives the Darlington transistor 36, which actuates the solenoid of the oil pump 12.

A second output from Pin 7 of the counter 22 is fed to the input of a NAND gate 72 which inverts the signal and its output is fed to a divide by 2 flip-flop 74 having an output fed to a second 12 stage binary counter 76 which divides the frequency by 4096. Thus, the total division of the frequency from the voltage to frequency converter 20 is 32,768. The pump 12 must therefore be activated 8 times before a signal would appear at the output of counter 76. This output is fed to set/reset flip-flop 78 which causes its output to go high. The output of flip-flop 78 is then fed to the reset line of astable multivibrator 80 which then allows it to oscillate. The output of the multivibrator 80, in connection with transistor 99, turns on the warning light 64 and horn 66 which alerts the operator to a no oil fault condition. This action will occur unless the oil flow reed switch 94 described below closes indicating that oil has been pumped. If the oil flow reed switch 94 closes, then this logic "low" signal is applied by line 95 through NAND gate 90 to the reset pins of flip-flop 74 and counter 76 causing them to reset to a zero count and preventing any signal from reaching the multivibrator 80. Thus no alarm would sound since normal oil flow has occurred. Resistor 97 and capacitor 98 operate through NAND gates 86,88 and 90 to provide a power-up reset for flip-flip 74, counter 76 and set/reset flip-flop 78. This circuitry prevents an erroneous alarm signal from occurring during the engine start cycle.

In the illustrated construction, there are two reed swtches, 92 and 94 utilized in connection with the oil pump 12, the first switch 92 is a magnetically operated electrical switch which senses a low oil condition and when closed, causes the low oil light 93 in the instrument head 28 to come on. The second reed switch 94, is a magnetically operated electrical switch which senses the flow of oil when the pump is pumped, resulting in the reed switch closing and providing pulses which are applied through NAND gate 90 to reset flip-flop 74 and counter 76 to prevent an alarm indication. The absence of 8 of these pulses results in an alarm indication as described above.

The system 10 can be calibrated, for example, by applying a frequency to the tach signal input that simulates an engine running at 5750 RPM when the desired ratio is 50:1 and measuring the output frequency at Pin 3 of the voltage to frequency converter 20, and adjusting the 1 K Pot 85 so the output is 9921 Hz, which results in providing the desired 50:1 ratio for a particular horsepower engine (in this case a 235 H.P. outboard). The throttle potentiometer arrangement includes an initial 10° dead band so that at 10° throttle position, and at 2750 RPM, the frequency at Pin 3 is 635 Hz, which provides a 150:1 ratio. The fuel to oil ratio increases from the 150:1 at 2750 RPM to 50:1 at 5750 RPM as a function of engine RPM and engine throttle position.

As noted at the beginning of this description, the various components which have been described and which make up the electronic lubricant metering system 10 can comprise various separate commercially available components. For example, the metering system 10 can be built using RCA cos/mos ("RCA") devices or National Semiconductor ("NS") devices having model numbers which correspond to the numbered components shown in the figure as follows:

| | | |
|---|---|---|
| Frequency to Voltage Converter 22 | LM2907N-8 | NS |
| Voltage to Frequency Converter 20 | LM331 | NS |
| Binary Counter 22 | CD4040 | RCA 12 stage binary counter |
| Astable Timer 24 | 556 | One half of NS timer 556 |
| NAND gates 72, 86, & 90 | | RCA four NAND gate package |
| Divide by 2 flip-flop 76 | CD4013 | One half of an RCA CD4013 |
| 12-Stage Binary counter 74 | CD4040 | RCA |
| Set-Reset Flip-Flop 78 | CD4013 | One half of an RCA CD4013 |
| Astable timer 80 | 556 | One half of a NS timer 556 |

As noted at the outset, the components in the electronic metering system 10 could also be combined into one or more integrated circuits or microprocessors, instead of being provided in discrete component form. Thus, it is to be understood that the invention is not confined to the particular construction and arrangement of components herein illustrated and described, but embraces all such modified forms thereof that come within scope of the following claims.

We claim:

1. An electronic lubricant metering system for an engine comprising first means for producing a first electrical signal representative of engine RPM, second means for producing a second electrical signal representative of the amount of fuel being delivered to the engine, lubricant supply means for supplying a variable amount of lubricant into the fuel delivered to the engine, and electrical control means responsive to said first and second electrical signals for providing a control output which renders said lubricant supply means operative to vary the lubricant/fuel ratio of the lubricant and fuel mixture delivered to the engine.

2. A metering system in accordance with claim 1 wherein the engine includes a throttle for regulating the amount of fuel delivered to the engine, and wherein said second means is coupled to the throttle so that said second electrical signal is representative of engine throttle position.

3. A metering system in accordance with claim 2 wherein said second means comprises a potentiometer including a wiper coupled to move in response to movement of the engine throttle, the voltage appearing on said wiper providing said second electrical signal.

4. A metering system in accordance with claim 2 wherein said lubricant supply means comprises an oil pump.

5. A metering system in accordance with claim 2 wherein said first means comprises means to provide an analog DC voltage representative of engine RPM, wherein said second means comprises a potentiometer connected so that said analog DC voltage is impressed across said potentiometer, said potentiometer including a wiper coupled to move in response to movement of the engine throttle so that the voltage output from said potentiometer wiper is a function of engine RPM and engine throttle position.

6. An electronic lubricant metering system in accordance with claim 1, wherein the engine includes a power source for providing power to said lubricant supply means and also includes transducer means for generating a voltage processed by said first means for producing said first electrical signal representative of engine RPM, said system further comprising overvoltage detection means including an operator warning device, said overvoltage detection means being coupled to said transducer means and to said power supply for interrupting the power supplied to said lubricant supply means and for activating said operator warning device when the voltage generated by said transducer means exceeds a predetermined upper value.

7. An electronic lubricant metering system in accordance with claim 1, further comprising low lubricant detection means for warning an engine operator when the lubricant supply means is not normally supplying lubricant into the fuel being delivered to the engine.

8. An electronic lubricant metering circuit for an engine including a throttle for regulating the amount of fuel delivered to the engine, which engine is also connected to a lubricant pump for supplying a variable amount of lubricant into the fuel delivered to the engine, said lubricant metering circuit comprising first means for producing a first electrical signal representative of engine RPM, second means for producing a second electrical signal representative of engine throttle position, and electrical control means responsive to said first and second electrical signals for providing a control output which renders the lubricant supply means operative to vary the lubricant/fuel ratio of the lubricant and fuel mixture delivered to the engine.

9. A metering circuit in accordance with claim 8 wherein said second means comprises a potentiometer including a wiper coupled to move in response to movement of the engine throttle, the voltage appearing on said wiper providing said second electrical signal.

10. A metering circuit in accordance with claim 8 wherein said first means comprises means to provide an analog DC voltage representative of engine RPM, wherein said second means comprises a potentiometer connected so that said analog DC voltage is impressed across said potentiometer, said potentiometer including a wiper coupled to move in response to movement of the engine throttle so that the voltage from said potentiometer wiper is a function of engine RPM and engine throttle position.

11. A metering circuit in accordance with claim 8, for an engine which also includes a power source for providing power to the lubricant pump and also includes transducer means for generating a voltage processed by said first means for producing said first electrical signal representative of engine RPM, said circuit further comprising overvoltage detection means including an operator warning device, said overvoltage detection means being coupled to said transducer means and to the power supply for interrupting the power supplied to the oil pump and for activating said operator warning device when the voltage generated by the transducer means exceeds a predetermined upper value.

12. An electronic lubricant metering circuit in accordance with claim 8, further comprising low lubricant detection means for warning an engine operator when the lubricant supply pump is not normally supplying lubricant into the fuel being delivered to the engine.

* * * * *